United States Patent [19]

Givens

[11] Patent Number: 4,890,569

[45] Date of Patent: Jan. 2, 1990

[54] LIFE RAFT

[75] Inventor: James A. Givens, Tiverton, R.I.

[73] Assignee: Givens Buoy Liferaft Co., Inc., Tiverton, R.I.

[21] Appl. No.: 200,453

[22] Filed: May 31, 1988

Related U.S. Application Data

[62] Division of Ser. No. 884,916, Jul. 14, 1986, Pat. No. 4,790,784.

[51] Int. Cl.[4] ..... B63C 9/04

[52] U.S. Cl. ..... 114/349; 114/125; 441/37

[58] Field of Search ..... 114/197, 349, 395, 348, 114/125; 441/35, 37, 38, 40, 41, 90, 91; 5/454

[56] References Cited

U.S. PATENT DOCUMENTS 1,089,338 3/1914 Greene ..... 114/197

2,946,342 7/1960 Dopplmaier ..... 137/517

3,883,913 5/1975 Givens ..... 441/37

4,001,905 1/1977 Givens ..... 441/37

FOREIGN PATENT DOCUMENTS 1498034 1/1978 United Kingdom ..... 114/197

*Primary Examiner*—Joseph F. Peters, Jr.

*Assistant Examiner*—Edwin L. Swinehart

*Attorney, Agent, or Firm*—Burns, Doane, Swecker & Mathis

[57] ABSTRACT

A self-bailing stabilized life raft includes a bailing chamber located between a stabilization chamber and a flotation platform. Water received from a flexible floor of the flotation platform is exhausted from the bailing chamber in response to wave and/or occupant interaction with the life raft. A raft inflation apparatus includes a pump chamber actuated by raft motion.

14 Claims, 3 Drawing Sheets

Fig. 2a
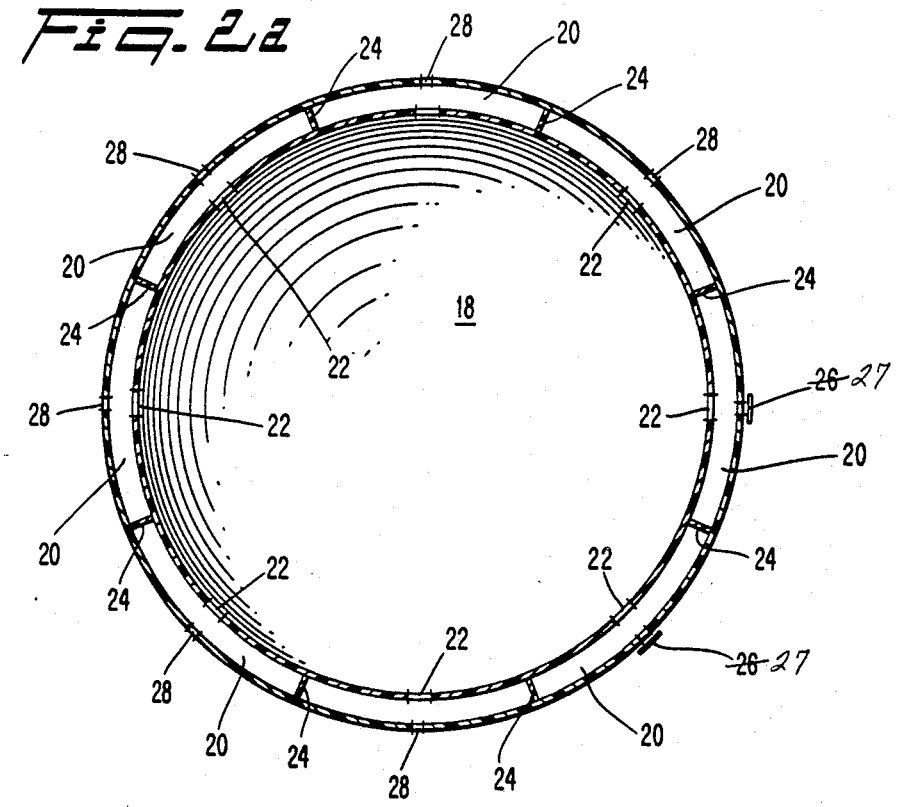
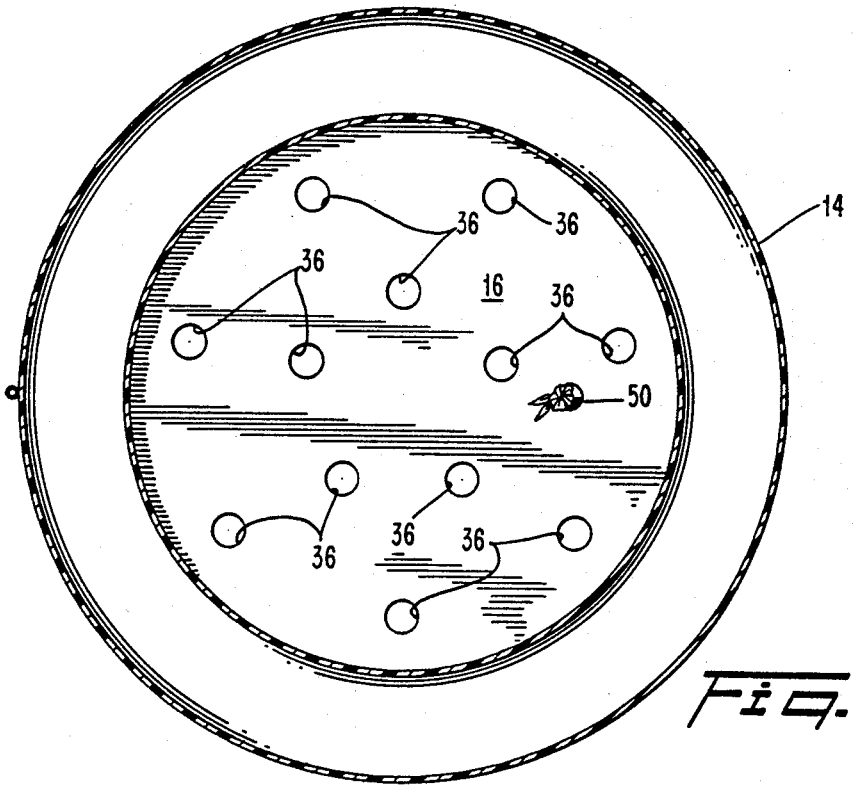
Fig. 2b

Fig. 3a
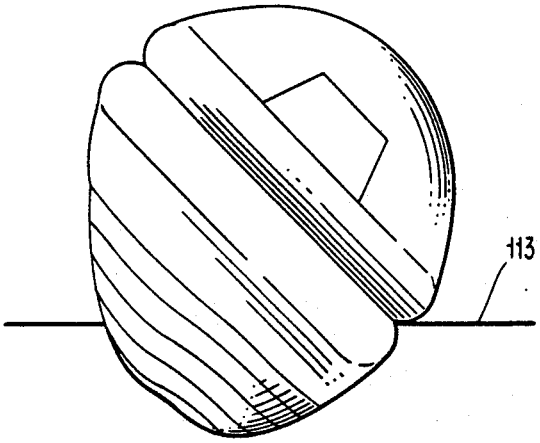
Fig. 4a
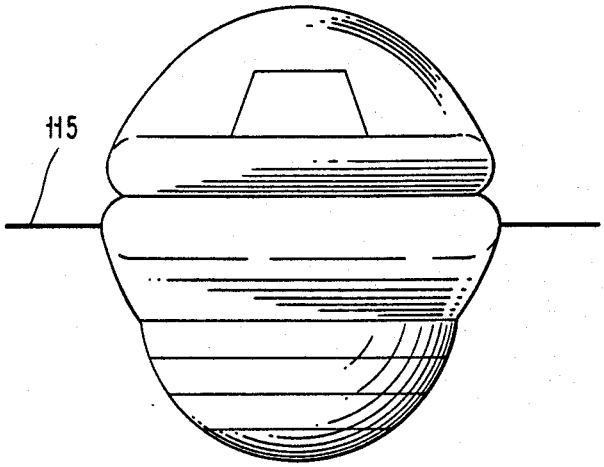
Fig. 3b
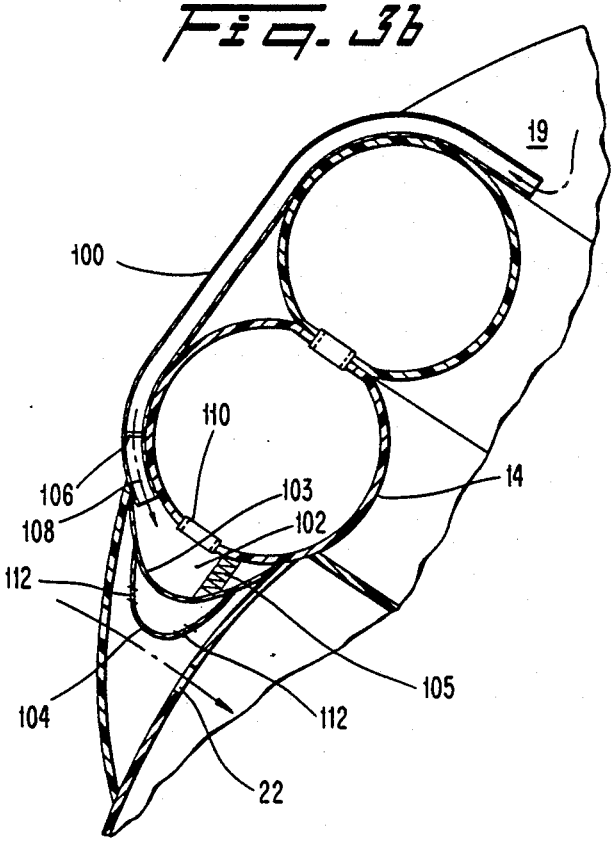
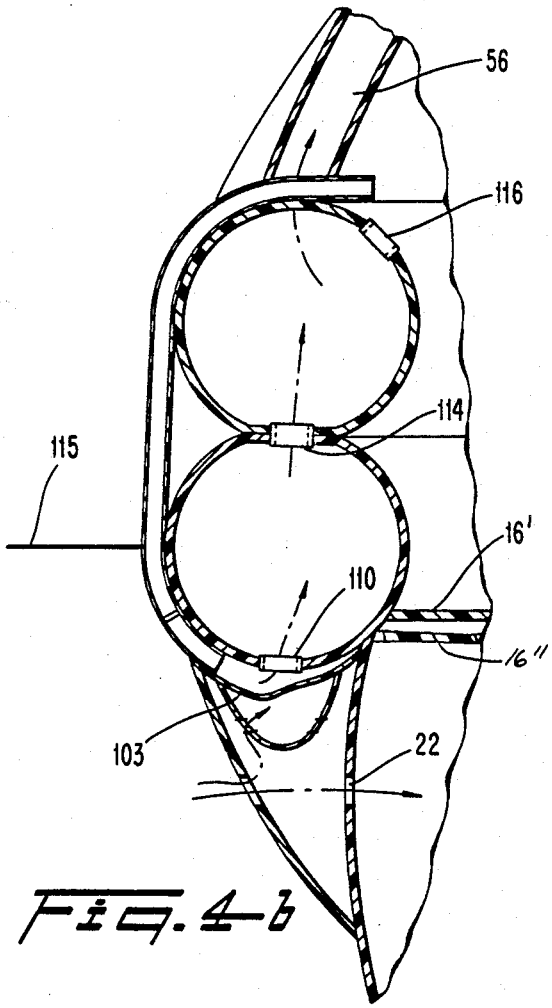
Fig. 4b

LIFE RAFT

This application is a divisional, of application Ser. No. 06/884,916, filed July 14, 1986 now U.S. Pat. No. 4,790,784.

BACKGROUND OF THE INVENTION

The present invention relates to life rafts having bailing systems and inflation systems and especially to stabilized life rafts employing wave action to assist such bailing and inflation systems.

Devices described in the prior art, such as shown in U.S. Pat. No. 3,064,282 to Kangas, employ hand water pumps for removing seepage water from a vessel. The hand pump exhausts seepage water through a hose having a check valve to prevent the inward seepage of water when the pump is not in use. One drawback of this method is that the occupant of the life raft must be sufficiently alert and mobile to operate the hand pump. In addition the seas must be sufficiently calm to permit the occupant to manipulate the pump. A further drawback to this approach is that the system requires a storage well from which the hand pump exhausts the water. In the case of rough seas, it may be very difficult if not impossible to bail such a vessel.

A water removal strategy is also shown in U.S. Pat. No. 2,399,494 to Manson et al. This patent describes a life raft having essentially two decks. Water residing on the upper deck flows through openings into a space between the two decks, thereby draining the upper deck. The lower deck has openings through which water can pass from between the decks out into the body of water upon which the raft floats. This device, however, is not particularly suitable for persons seeking refuge in high seas.

In view of the deficiencies of the prior art, it is an object of the present invention to provide a self bailing system for a life raft, including systems for stabilized life rafts adapted for use in the high seas. By various mechanisms which will be discussed hereinafter, the present invention provides a life raft which automatically bails water from the raft floor. The self bailing aspect of the present invention thus allows the occupants of the life raft to attend to matters other than bailing, such as sleep, medical care, and other activities necessitated by the circumstances.

Raft inflation systems known in the prior art include pressurized gas cylinders and valves which inflate inflation tubes of the raft upon deployment. Such systems may also include pressure relief valves which release gas from the tubes when pressure in the tubes exceeds a predetermined threshold. This may occur when wave action buckles the life raft causing it to deform and release gas from the inflation tubes. In addition, temperature drops may reduce inflation tube pressure. When the gas cylinders are spent, there is no additional source of pressurized gas with which to sustain inflation of the inflation tubes as needed. While hand pumps can be used to inflate rafts, as noted concerning the prior art mentioned above, hand pumps may be difficult or impossible to use in high seas to maintain inflation tube pressure.

Accordingly, it is an object of the present invention to provide an inflation system to inflate or reinflate a life raft on an as needed basis without relying exclusively on gas cylinders.

It is another object of the present invention to provide an inflation system for dynamic adjustment of pressure in the raft inflation tubes.

It is yet another object of the present invention to provide an inflation system which efficiently harnesses wave action and raft motion to provide dynamic adjustment of pressure in the raft inflation tubes.

It is a further object of the present invention to provide a system to bail a life raft which does not rely on hand pumps.

Still further, an additional object of the present invention is to provide a bailing system for a life raft which harnesses the natural motion of the raft to effectuate bailing.

These and other objects and features of the present invention will be apparant from this written description and appended drawings.

SUMMARY OF THE PREFERRED EMBODIMENTS

A preferred embodiment of the present invention relates to novel self bailing and self inflating stabilized life rafts.

The basic life raft includes a flotation platform for carrying at least one occupant. Typically the flotation platform includes one or more peripheral, inflatable buoyant members or tubes and a flexible floor spanning a buoyant member. One or more stabilization chambers, adapted to fill with water when the life raft is deployed, may be provided. For example, a generally hemispheric chamber formed of a flexible sack may depend from the periphery of the flotation platform. A mass of water in the stabilization chamber may be loosely coupled to the flotation platform.

A bailing system for the life raft may be located between the flotation platform and a stabilization chamber. In a preferred embodiment the bailing chamber may comprise a flexible sheet having a peripheral edge attached to the flotation platform. The flexible sheet may have an area greater than an area of the flotation platform circumscribed by the attached peripheral edge of the flexible sheet. Portions of the flexible sheet not attached to the flotation platform are adapted to move relatively to the flexible floor, whereby the volume of the bailing chamber increases and decreases responsive to raft movement and relative movement between the floor and the flexible sheet. Spaced openings in the floor are provided to permit water collecting on the flexible floor to pass into the bailing chamber, and check valves may be provided in the spaced openings to prevent water in the bailing chamber from being exhausted back through the openings onto the floor. A water outlet sleeve may be attached to the flexible sheet to provide an outlet through which water is exhausted from the bailing chamber into a stabilization chamber at a location beneath the flexible sheet. In response to forces acting on the raft, the flexible floor, and a stabilization chamber, water is drawn into the chamber through the floor and expelled from the bailing chamber.

The pumping action is particularly effective in a stabilized raft of the type shown in the appended drawings. Such rafts can heel to high angles without rolling over or otherwise becoming unstable. The upward and downward motions of the raft facilitate operation of the bailing system by forcing the bailing chamber to expand and contract. Bailing of the raft prevents accumulation of water above the raft floor which could tend to destabilize the raft and raise its center of gravity. The stabilization chamber may also shield the bailing chamber from direct wave impact which could rupture it.

An inflation system is provided for the life raft to inflate the buoyant tubes. In a preferred embodiment, the inflation system includes an air pump chamber defined by a flexible diaphragm and a wall of an inflation tube. The diaphragm is adapted for movement relative to the inflation tube. Air enters the air pump chamber through a conduit and a check valve is provided between the air pump chamber and the inflation tube for permitting the passage of air from the air pump chamber into the inflation tube. A drag buoy may depend from the air pump chamber and be adapted to fill with water when the raft is deployed. When the raft motion causes the inflation system to move upwards out of the water, a downward force is exerted by the drag buoy on the diaphragm to expand the volume of the air pump chamber, thereby causing air to be taken through the conduit into the air chamber. Air in the air pump chamber is subsequently exhausted into the inflation tube when raft motion causes the air pump chamber to move downwardly. When the air chamber is submerged below the water line, air is forced through one or more check valves into an inflation tube. The weight of raft occupants and of the stabilization chamber facilitate this action. When the flotation platform includes two or more inflatable tubes, valves may be provided between the tubes for allowing air from a tube pressurized by the inflation system to enter an adjacent tube. By this mechanism, all the inflatable tubes of the raft, including canopy support tubes, may be reinflated by the present system. This inhibits raft buckling and loss of buoyancy.

In combination with the foregoing air pumping system, a preferred embodiment includes pressure relief valves. The inflation tubes and may be temporarily over-pressurized by wave action against the raft or other environmental effects. The pressure relief valves avoid rupture of the tubes due to over-pressurization. The tubes may be subsequently reinflated by the self-inflation system to desired working pressure, typically from 2 to 5 psi. In heavy seas the pressure relief valves may release gas frequently to provide pressure stabilization. Thus, the inflation system harnesses wave action and raft motions and provides dynamic adjustment of pressure in the raft inflation tubes in response to environmental conditions.

BRIEF DESCRIPTION OF THE DRAWINGS

FIG. 2*a* is a cross-sectional view taken along plane A—A of FIG. 1, showing a preferred arrangement of stabilization chambers and associated valves and ports.

FIG. 2*b* is a cross-sectional view taken along plane B—B of FIG. 1, including a view of the life raft floor.

FIG. 3*a* is a pictorial view of a life raft embodiment of the present invention heeling in heavy seas.

FIG. 3*b* is a cross-sectional view of a portion of the life raft shown in FIG. 3*a* illustrating the operation of an inflation system embodiment of the present invention.

FIG. 4*a* is a pictorial view of a life raft embodiment of the present invention deployed in a level state.

FIG. 4*b* is a cross-sectional view a portion of the life raft shown in FIG. 4*a*, illustrating the operation of an inflation system embodiment of the present invention.

DETAILED DESCRIPTION OF PREFERRED EMBODIMENTS

The present invention includes improvements which may be implemented in stabilized life rafts of the general type depicted in applicant's U.S. Pat. No. 4,001,905. Embodiments of such life rafts include a flotation platform for carrying at least one occupant, a canopy for protecting the occupant(s) from the elements, and one or more depending stabilization chambers adapted to fill with water when the raft is deployed.

Figure 1:
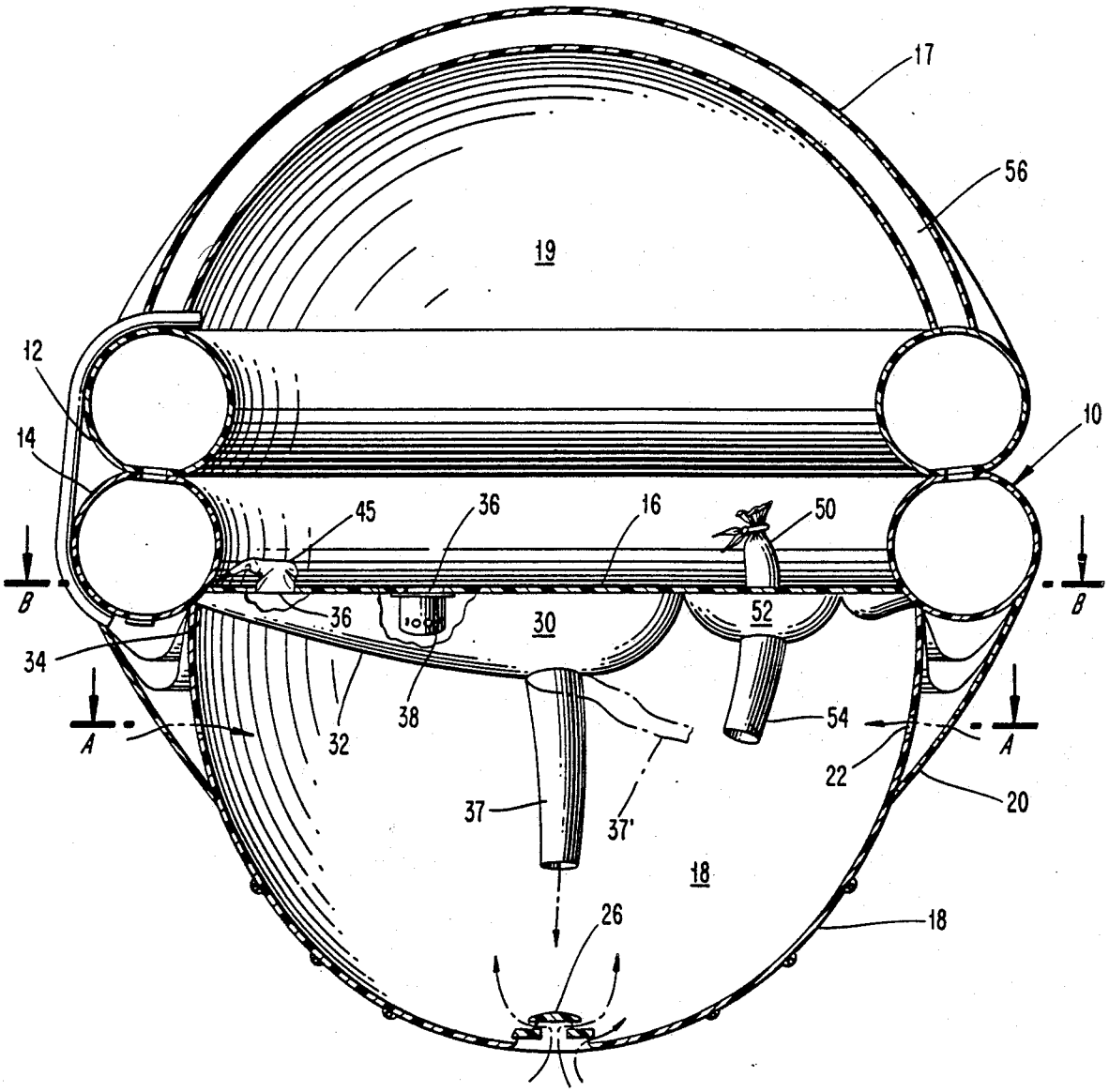
FIG. 1 is a cross-sectional view of a self bailing stabilized life raft of a preferred embodiment of the present invention.

Referring first to FIG. 1, a stabilized life raft is depicted having a flotation platform 10 for carrying and supporting at least one occupant of the life raft. The flotation platform may include a circumferential buoyant member, such as inflation tubes 12 and 14, and, a flexible floor 16 spanning a buoyant member. A semi-rigid canopy 17 may enclose a passenger compartment 19. One or more stabilization chambers may be provided which depend from flotation platform. In the embodiment of FIG. 1, both a pendulous, generally hemispheric main stabilization chamber 18 and a toroidal stabilization chamber 20 are employed.

The stabilization system of the raft of FIG. 1 will first be described in detail. The main stabilization chamber 18 is formed of a flexible sack which fills with water when the life raft is deployed. FIG. 2*a* is a cross-sectional view taken along plane A—A, which shows the interrelationship of the stabilization chambers.

As shown in FIG. 2*a*, ports 22 permit water flow between the toroidal stabilization chamber 20 and the main stabilization chamber 18. The toroidal stabilization chamber may be divided into sections by baffles 24. Such baffles are shown in U.S. Pat. No. 1,886,522 to Buck. When the raft is initially deployed, water may enter the sections of the chamber 20 by way of valves 27 or ports 28. The ports 28 and valves 27 are positioned radially around the toroidal stabilization chamber. The valves 27 may be flap valves which act as check valves to allow water to enter the stabilization chamber 20 but which do not allow water to leave the stabilization chamber 20 from that area. The flap valves may be located in an area below a door in the raft canopy, and provide immediate stabilization in that area so that the raft may be boarded in rough seas. The ports 28 are essentially openings which allow controlled passage of water into the toroidal stabilization chamber 20. Water in the toroidal stabilization chamber may then flow through ports 22 to fill the main stabilization chamber 20.

With reference to FIG. 1, the stabilization chamber 18 is also provided with a valve 26 at the bottom thereof. This valve 26 acts as a partial check valve to prevent a rapid flow of water out of the stabilization chamber 18 and to allow a flow of water into the stabilization chamber. In operation the toroidal stabilization chamber 20 can act as a temporary stabilization chamber while the main stabilization chamber 18 is filling.

The bailing system of the raft of FIG. 1 will now be described in detail. A bailing chamber 30 may be located between the flexible floor 16 and the main stabilization chamber 18. The bailing chamber may be defined by a flexible sheet 32 having a peripheral edge 34 attached to the flotation platform 10 near a point of attachment of the floor to the buoyant member. Further, the flexible sheet 16 of the bailing chamber has an area greater than an area of the flotation platform circumscribed by the attached peripheral edge of the flexible sheet. The flexible sheet 16 is pliable and deformable and thus able to move relative to the floor. Such movement between the flexible sheet and the flexible floor causes the volume of the bailing chamber 30 defined by the flexible sheet and the portion of the flotation platform to which it is attached to increase and decrease responsive to relative movement between the platform and the sheet. As described more fully hereinafter, pressure from water within the stabilization chamber facilitates expulsion of water from the bailing chamber 30 through a water outlet sleeve 37. Advantageously, the sleeve may be located near the center of the raft and the flexible sheet, so that, when the raft heels, the sleeve may open and extend downwardly to facilitate the escape of water in the bailing chamber. When the raft is level, the sleeve may collapse as shown in phantom at 37'.

Water on the flexible floor may be drawn into the bailing chamber through a number of holes 36 in the floor. An arrangement of these holes 36 may be employed as shown in FIG. 2*b*. These openings 36 are arranged at spaced locations in the flexible floor 16 of the life raft. The holes 36 are associated with check valve structures 38 as shown in FIG. 1 which allow water on the flexible floor to enter the bailing chamber. These check valve structures also inhibit water from the bailing chamber from exiting through the holes when the flexible sheet is moved toward the flexible floor.

Figure 5:
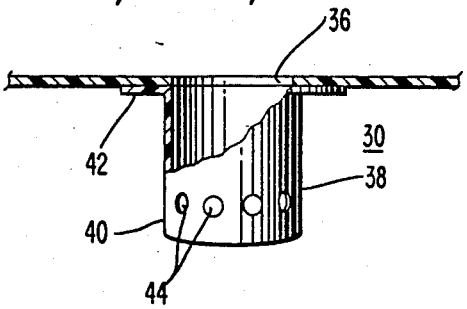
FIG. 5 is a pictorial view, in partial cut-away, of a floor check valve employed in the embodiment shown in FIG. 1.

A preferred embodiment of the check valve structure is shown in greater detail in FIG. 5. The structure may include a flexible cup-shaped member 40 having an upper peripheral edge 42 attached about the periphery of hole 36. In operation, when the chamber 30 is expanded, water may flow from the floor 16, into the cup shaped member 40, and out into the chamber 30 through holes 44 in a cylindrical wall of the cup shaped member. When the chamber 30 is filled with water or when the sheet 32 presses against it, the cup-shaped member collapses essentially blocking the passage of water through the holes 44 back onto the floor 16.

Alternatively or additionally, the check valve structure may comprise a sleeve, such as sleeve 45 shown in FIG. 1, which can be tied shut when bailing is unnecessary to prevent backflow or seepage from the bailing chamber 30.

The bailing mechanism is operated by periodically varying pressure or impact against the bailing chamber. For example, waves may impact the raft and force water contained within the stabilization chamber 18 against the flexible sheet 32. This, in turn, forces the flexible sheet 32 to move towards the flexible floor 16, thereby decreasing the volume of the bailing chamber 30 and forcing water contained in the bailing chamber to exit through the water outlet sleeve 37 into the stabilization chamber. Excess water contained within the stabilization chamber ebbs and flows through the valve 26 and through the peripheral ports 22 around the stabilization chamber. Impacting wave action may cause chamber 30 to rise above the water line. This action is particularly effective in a raft having a stabilization system of the type shown in U.S. Pat. No. 4,001,905. In operation in high seas the raft may heel as shown in FIG. 3*a*, thus raising all or part of the bailing chamber above the water line. In this instance, the sleeve 37 will open and water will flow downwardly out of the bailing chamber 30. Water remaining in the bailing chamber may cause the flexible sheet to move away from the flotation platform, thereby increasing the volume of the bailing chamber and causing water on the flexible floor to be drawn into the bailing chamber through the spaced openings in the floor. Wave action may also submerge the bailing chamber. This submerging of the bailing chamber and/or direct wave impacts against the life raft, act to compress the bailing chamber and force water out of the bailing chamber and into the stabilization chamber. While the flexible sheet is being urged towards the flotation platform to decrease the volume of the bailing chamber, the check valves 38 prevents water contained in the bailing chamber from exhausting onto the floor of the life raft. Thus wave motion effectuates automatic bailing of the life raft.

It should also be noted that pressure from occupants walking, jumping, or falling, on the flexible floor or pressing thereon can similarly change the volume of the bailing chamber by partially tipping the raft and/or by moving the flexible floor toward and away from the flexible sheet. Bailing can thus be accomplished in a manner similar to that described above but by the motion of the occupants of the life raft instead of or in addition to wave action.

When the life raft is first deployed, it is an unstable, rumpled mass. As the buoyant members of the flotation platform begin to inflate, water enters through flap valves 26 adjacent an entry/exit area to stabilize the raft while persons board the raft. Water entering these flap valves, as well as the ports 28 radially spaced about the periphery of the raft, first fills a toroidal stabilization chamber 20 which extends along the periphery of the raft. Water from the toroidal stabilization chamber then enters the main stabilization chamber 18 through ports 22 as shown in FIG. 4*b*. Meanwhile, water also enters the main stabilization chamber via check valve 26 at the bottom thereof as shown in FIG. 1. The valve 26 is essentially a one-way valve which allows water into the main stabilization chamber and which prevents a rapid flow of water out of the stabilization chamber due to sudden movement of the raft. However, valve 26 does allow some water to slowly drain from the main stabilization chamber. A sudden wave impact on the main stabilization chamber 18 will maintain the valve 26 essentially closed.

In a preferred embodiment of the present invention, the flexible floor 16 is composed of at least two layers (layers 16' and 16'' in FIG. 4*b*). Most preferred is where the floor has a thermal insulating material surrounded by the two layers. This acts to strengthen the floor and to avoid heat losses from the occupants into the surrounding water and into the water in the bailing and stabilization chambers. The flexible sheet 32 of the bailing chamber is, in any event, attached to at least a portion of the underside of the flexible floor, whether of a single or a multiple layer.

Because occupants of a life raft may be adrift for an extended period of time, it is useful to provide means for the evacuation of human waste. As shown in FIG. 1, the depicted raft embodiment includes an evacuation tube 50 which empties into a waste chamber 52 which exhausts into the main stabilization chamber 18 through a waste outlet sleeve 54. Occupants of the life raft evacuate themselves through the waste tube 50 into the waste chamber 52. Wave action, similarly exhausts the waste chamber via the waste outlet sleeve in a manner similar to the operation of the automatic bailing system described above. To prevent human waste and/or water from entering back onto the flexible floor through the waste chamber, the waste tube is sealable, such as by tying it off.

The inflation system employed in preferred embodiments of the present invention will now be described. When the raft is first deployed, a bottle or cylinder (not shown) containing compressed gas, secured to a part of the raft, is activated either manually or by water pressure to inflate the flotation platform and supports 56 for the canopy.

The present invention also provides an alternative or supplemental system for inflating the life raft. A preferred embodiment of such a system will now be described in connection with FIG. 3*b*. The system generally comprises a conduit 100 which feeds into an air pump chamber 102 and a drag buoy chamber 104. An intake check valve 106 facilitates air flow in the direction indicated by arrow 108. The conduit and check valve act as an air intake which conducts dry air from the passenger compartment 19 into the air pump chamber 102. When pressure in the chamber 102 exceeds a predetermined value, valve 110 opens permitting the air to enter the inflation tube 14. Water flowing into the torroidal stabilization chamber 20 enters the drag buoy chamber via ports or valves 112.

The operation of the inflation system will now be described. When deployed, the toroidal stabilization chamber 20 will be filled with water. Water from this chamber may pass into the drag buoy chamber 104 through valves or ports 112, thereby filling the drag buoy chamber as shown in FIG. 3*b*.

As shown in FIG. 3*a* the raft may heel due to wave or wind action or movement of the raft occupants or a combination thereof. In FIG. 3*a*, line 113 is a horizontal reference line, and the flotation platform is shown at about a 45° angle with respect to the reference line. As shown in FIG. 3*b*, when the raft heels, the drag buoy 104 acts as a weight drawing diaphragm 103 downward so that air is taken into the air pump chamber 102. Alternatively, a spring loaded mechanism 105 may be employed to expand the pump chamber. As seen in FIG. 3*b*, air moves from the passenger compartment 19 through the conduit 100, and check valve 106 into air pump chamber 102.

To prevent water in the air buoy chamber from always flowing towards a lower portion of the raft, baffles may be provided at various distances around the drag buoy chamber to isolate it into sections. Alternatively, one or more separate air pump chambers and associated drag buoy chambers can be provided each extending along only part of the periphery of the flotation platform.

When the portion of the raft shown in FIG. 3*b* moves downward, wave action, the weight of the raft and occupants and the inertia of the water in the drag buoy chamber and stabilization chambers may submerge the air filled pump chamber 102. A raft orientation in which this occurs is depicted in FIG. 4*a* in which the raft water line is identified by numeral 115. In this orientation air in the air pump chamber is pressured resulting in expulsion of the air through the check valve 110 as shown in FIG. 4*b*, in which the diaphragm 103 is shown in a collapsed state. To ensure adequate air pressure in the inflation tube member, the check valve 110 may require a pressure difference of from about ¼ psi to about 4 psi before it opens.

As air is forced into the first buoyant member via the air pump chamber and check valve, the pressure in the first inflation tube 14 may increase. An isolation valve 114 may be provided between inflation tube 14 and inflation tube 12. An increase in pressure in tube 14 may cause air to pass through isolation valve 114 into tube 12 as shown in FIG. 4*b*.

The foregoing thus describes how the present invention provides a means for automatically inflating the buoyant members. However, as wave action continuously operates the inflation system the inflation tubes continuously pressurize. The present invention also provides a blow-off valve 116 which allows air to escape from the inflation tubes. As the raft is oscillated and tossed by the sea the foregoing method thus allows the flotation platform to remain in a state of sustained rigidity. The combined action of the air pump chambers and the blow-off valves insures that the buoyant members of the flotation platform are continuously pressurized.

The foregoing description of the interplay between the air pump and the blow-off is also important for various other reasons. For example, if blow-off valves were not provided, when large waves impacted the raft the pressure may be so great as to rupture one or more of the inflation tubes. In another instance, if the raft is deployed into cold water, or for large drops in nighttime temperature, the pressure of the air in the buoyant members will decrease due to the decrease in temperature. It is thus necessary to provide a means to maintain the buoyant members of the flotation platform in a state of sustained rigidity irrespective of the ambient pressure, temperature, or varying wave action on the life raft.

It is thus seen that the present invention provides an improved life raft. As the raft of the present invention is tossed in the sea and acted upon by waves, water which accumulates on the floor of the life raft is removed therefrom and automatically bailed by waves or occupants acting on the life raft. This wave action and oscillation of the life raft also acts to maintain the inflatable members in a state of sustained rigidity via the inflation system, thereby insuring a buoyant force for the life raft. The buoyant members are further provided with valves to avoid their over-pressurized by the inflation system or wave action. Moreover, the inflation system which insures that the inflated members remain rigid also acts to compensate for pressure changes due to decreases in temperature of the surrounding environment. While enclosing the occupants of the life raft and sheltering them from the outside environment, the present invention also provides a human waste removal system for the occupant without their being exposed. It is thus seen how the forces of wave action on the life raft may function to bail the life raft and to ensure that the inflation tubes are sufficiently inflated.

The foregoing embodiments of the present invention are meant to be descriptive and not limiting. Various alterations, modifications and adaptations of the present invention may be made by those of ordinary skill in the art; such changes are meant to be within the spirit and scope of the present invention as defined by the claims.

I claim:

1. A self-bailing, stabilized life raft, comprising:

a flotation platform having buoyant members and a flexible floor spanning said members, said floor having means for allowing water to pass through the floor, and a means for preventing a flow of water in an opposite direction;

a stabilization chamber depending from said platform and containing a volume of water, which volume of water acts as a drag force on the raft and is loosely coupled to the flotation platform raft;

a bailing chamber between said floor and said stabilization chamber for receiving water from the floor and for exhausting water into a stabilization chamber in response to raft motion relative to the body of water in which the raft is located, said bailing chamber comprising a flexible sheet attached to said floor along a peripheral edge of said flexible sheet, the area of said flexible sheet being greater than the area of the floor circumscribed by attachment to the sheet, said flexible sheet being mounted for generally upward movement relative to said flotation platform responsive to exertion of an upward force, thereby to expel water present in said bailing chamber;

a water outlet, attached to the flexible sheet at a location where water collects in the bailing chamber; and at least one check valve in the floor, through which water is drawn from the floor into the bailing chamber in response to expansion of the bailing chamber caused by raft motion and downward force of water in the bailing chamber against the flexible sheet.

2. A self-bailing, stabilized life raft comprising:

a flotation platform for carrying at least one life raft occupant, including a peripheral buoyant member and a floor spanning said buoyant member and supported thereby;

at least one stabilizing chamber located beneath the flotation platform, said stabilizing chamber being adapted to be filled with water when the life raft is deployed; and a bailing chamber located between said stabilizing chamber and said flotation platform, for receiving water from the floor, and for exhausting water from the bailing chamber in response to intermittent compression of the bailing chamber due to wave interaction with the life raft causing water in the at least one stabilizing chamber to exert an upward force on the bailing chamber which is opposed by the weight of the at least one occupant, said bailing chamber having a lower wall mounted for generally upward movement relative to said flotation platform responsive to exertion of said upward force, thereby to expel water present in said bailing chamber therefrom.

3. The life raft of claim 2 wherein the bailing chamber is defined by the floor and the lower wall of the bailing chamber, said lower wall comprising a flexible sheet adapted for relative movement with respect to the floor to increase and decrease the volume of the bailing chamber, said flexible sheet having a peripheral edge attached to the flotation platform and having an area greater than the area of the flotation platform circumscribed by the attached edge.

4. The life raft of claim 3 further comprising at least one check valve through which water collecting on the raft floor may pass into the bailing chamber.

5. The life raft of claim 2 further comprising a water outlet sleeve through which water is exhausted from the bailing chamber into the stabilization chamber in response to pressure exerted on the chamber due to wave interaction with the life raft.

6. The life raft of claim 5 wherein the pressure exerted on the bailing chamber is a varying pressure caused by shifting of water within the stabilization chamber.

7. The life raft of claim 5 wherein the pressure exerted on the bailing chamber is a varying pressure caused by shifting of the weight of the raft occupants on the floor.

8. The life raft of claim 2 wherein the floor comprises two sheets of flexible material, each of which span the buoyant member to form a two layer, thermally insulating floor.

9. The life raft of claim 2 wherein the at least one stabilization chamber is generally hemispheric in shape and defined by a flexible sack which depends from the flotation platform, an edge of said sack being attached to the periphery of the flotation platform.

10. The life raft of claim 9 wherein an upper wall of the stabilizing chamber is defined by the lower wall of the bailing chamber.

11. The life raft of claim 2 wherein the at least one stabilization chamber is a toroidal in shape located about the periphery of the flotation platform and depending therefrom.

12. The life raft of claim 2 wherein the buoyant member is one or more tubes which are inflated when the life raft is deployed.

13. The life raft of claim 2 further comprising a substantially water-tight canopy covering said flotation platform.

14. A self-bailing stabilized life raft comprising:

a flotation platform for carrying at least one life raft occupant, including a peripheral buoyant member and a floor spanning said buoyant member and supported thereby;

at least one stabilizing chamber depending from the flotation platform, said stabilizing chamber being adapted to be filled with water when the life raft is deployed;

a bailing chamber located beneath the floor for receiving water from the floor through a one way check valve; and a water outlet sleeve through which water exits the bailing chamber when at least a portion of the bailing chamber is raised upwardly by wave action;

said bailing chamber having a lower wall mounted for generally upward movement relative to said flotation platform responsive to said wave action, thereby to expel water present in said bailing chamber through said water outlet sleeve.

* * * * *